US009833368B2

(12) United States Patent
Turner

(10) Patent No.: US 9,833,368 B2
(45) Date of Patent: Dec. 5, 2017

(54) PERSON SUPPORT APPARATUS WITH SPRING ASSISTANCE FOR ARTICULATION

(71) Applicant: Hill-Rom Services, Inc., Batesville, IN (US)

(72) Inventor: Jonathan D. Turner, Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 170 days.

(21) Appl. No.: 14/065,826

(22) Filed: Oct. 29, 2013

(65) Prior Publication Data

US 2014/0115785 A1 May 1, 2014

Related U.S. Application Data

(60) Provisional application No. 61/721,159, filed on Nov. 1, 2012.

(51) Int. Cl.

| | |
|---|---|
| ***A61G 7/002*** | (2006.01) |
| ***A61G 7/015*** | (2006.01) |
| ***A61G 7/05*** | (2006.01) |
| *A61G 7/018* | (2006.01) |
| *A61G 7/053* | (2006.01) |

(52) U.S. Cl.

CPC ..... *A61G 7/015* (2013.01); *A61G 7/0509* (2016.11); *A61G 7/0514* (2016.11); *A61G 7/018* (2013.01); *A61G 7/053* (2013.01)

(58) Field of Classification Search

CPC ..... A61G 7/018; A61G 7/015; A61G 7/002

USPC ..... 5/614, 617, 613; 108/118, 119, 147; 154/69, 70, 71

See application file for complete search history.

(56) References Cited

U.S. PATENT DOCUMENTS

| | | | | |
|---|---|---|---|---|
| 2,297,105 | A * | 9/1942 | Laukhuff | A61G 7/015 5/614 |
| 2,687,536 | A * | 8/1954 | Miller | A61G 7/002 137/614.11 |
| 4,004,836 | A * | 1/1977 | Kristensson | A61G 5/12 297/301.2 |
| 5,129,116 | A | 7/1992 | Borders et al. | |
| 5,423,097 | A | 6/1995 | Brule et al. | |
| 5,444,880 | A | 8/1995 | Weismiller et al. | |
| 5,806,111 | A | 9/1998 | Heimbrock et al. | |
| 5,996,151 | A | 12/1999 | Bartow et al. | |
| 6,000,076 | A * | 12/1999 | Webster et al. | 5/618 |
| 6,047,424 | A | 4/2000 | Osborne et al. | |
| 6,247,753 | B1 * | 6/2001 | Alvestad | 297/362.13 |
| 6,643,873 | B2 | 11/2003 | Heimbrock et al. | |
| 6,654,974 | B2 | 12/2003 | Ruehl et al. | |
| 6,854,145 | B2 | 2/2005 | Ruehl et al. | |
| 6,857,153 | B2 | 2/2005 | Ruehl et al. | |
| 7,124,456 | B2 * | 10/2006 | Palmatier et al. | 5/617 |

(Continued)

*Primary Examiner* — Robert G Santos
*Assistant Examiner* — Ifeolu Adeboyejo
(74) *Attorney, Agent, or Firm* — Barnes & Thornburg LLP

(57) ABSTRACT

A spring assist system for use with a person support apparatus is described herein. The spring assist system comprises a spring which applies a spring force on a head support deck section to aid in motion from a first position at a higher inclination to a second position at a lower inclination with respect to a supporting frame member. The spring assist system is configured to exclusively apply spring force between the first position and the second position.

17 Claims, 8 Drawing Sheets

(56) References Cited

U.S. PATENT DOCUMENTS

| | | | | |
|---|---|---|---|---|
| 7,261,286 | B2 * | 8/2007 | McConnell | F16F 1/12 180/69.21 |
| 7,296,312 | B2 | 11/2007 | Menkedick et al. | |
| 7,469,433 | B2 * | 12/2008 | Ruehl et al. | 5/617 |
| 7,559,102 | B1 * | 7/2009 | Benzo et al. | 5/618 |
| 7,836,531 | B2 | 11/2010 | Girard et al. | |
| 8,516,634 | B2 * | 8/2013 | Turner et al. | 5/600 |
| 8,555,438 | B2 * | 10/2013 | Turner et al. | 5/618 |
| 2005/0005357 | A1 * | 1/2005 | Van Raemdonck | 5/617 |
| 2005/0166323 | A1 * | 8/2005 | Kawakami | A61G 7/001 5/610 |
| 2006/0112488 | A1 * | 6/2006 | Lemire et al. | 5/617 |
| 2007/0266499 | A1 | 11/2007 | O'Keefe et al. | |
| 2009/0044339 | A1 * | 2/2009 | Morin et al. | 5/617 |
| 2009/0094748 | A1 * | 4/2009 | Long | 5/613 |
| 2010/0123276 | A1 * | 5/2010 | Adoline | F16F 13/007 267/69 |
| 2011/0094032 | A1 * | 4/2011 | Shih | 5/614 |

* cited by examiner

PERSON SUPPORT APPARATUS WITH SPRING ASSISTANCE FOR ARTICULATION

CROSS REFERENCE TO RELATED APPLICATIONS

The present application claims the benefit, under 35 U.S.C. §119(e), of U.S. Provisional Application No. 61/721,159, which was filed Nov. 1, 2012, and which is hereby incorporated by reference herein.

BACKGROUND

Patient positioning is a significant concern in healthcare settings, particularly in circumstances wherein a patient supported by a person support apparatus is to be re-positioned from an elevated head of bed angle position of the person support apparatus to a horizontal position for administration of Cardiopulmonary Resuscitation (CPR). While several systems and methods have been developed to help re-position a person supported by a hospital bed, an opportunity exists for continued development in this area.

BRIEF SUMMARY

The present disclosure includes one or more of the features recited in the appended claims and/or the following features which, alone or in any combination, may comprise patentable subject matter.

One embodiment of a spring assist system for use with a person support apparatus, the person support apparatus may comprise a head support deck section supported by a supporting frame, the head support deck section configured to be variably inclined with respect to the supporting frame. The spring assist system may comprise a spring assembly. The spring assembly may comprise a spring configured to apply spring force assisting motion of the head support deck section from a first position to a second position wherein the head support deck section in the first position is at greater angle of inclination with respect to the supporting frame than in the second position and angular inclination of the head support deck section in the second position is greater than 0 degrees and less than 50 degrees, the spring assembly configured to apply spring force exclusively between the first position and the second position.

One embodiment of a person support apparatus may comprise a lower frame, an intermediate frame, at least one support configured to variably elevate the intermediate frame over the lower frame. A weigh frame may be supported by the intermediate frame. A deck section supported by the weigh frame may be configured to support a portion of a person's upper body thereon, the deck section configured to be inclined with respect to the weigh frame. A spring assembly may comprise a spring configured to apply spring force assisting motion of the deck section from a first position to a second position wherein the deck section in the first position is at greater angle on inclination with respect to the weigh frame than in the second position and angular inclination of the deck section in the second position is greater than 0 degrees and less than 50 degree, the spring assembly configured to apply spring force exclusively between the first position and the second position.

Another embodiment of a person support apparatus may comprise a head support deck section configured to be inclined with respect to a supporting frame. The person support apparatus may comprise means for providing a force exclusively between a first position and a second position, the force assisting motion of the head support deck section from the first position to the second position wherein the head support deck section in the first position is at greater angle of inclination with respect to the supporting frame than in the second position and angular inclination of the head support deck section in the second position is greater than 0 degrees and less than 50 degrees.

BRIEF DESCRIPTION OF THE DRAWINGS

The accompanying drawings incorporated in and forming a part of the specification illustrate several aspects of the claimed subject matter and, together with the description, serve to explain the principles of the claimed subject matter. In the drawings:

DETAILED DESCRIPTION OF ILLUSTRATIVE EMBODIMENTS

Figure 1:
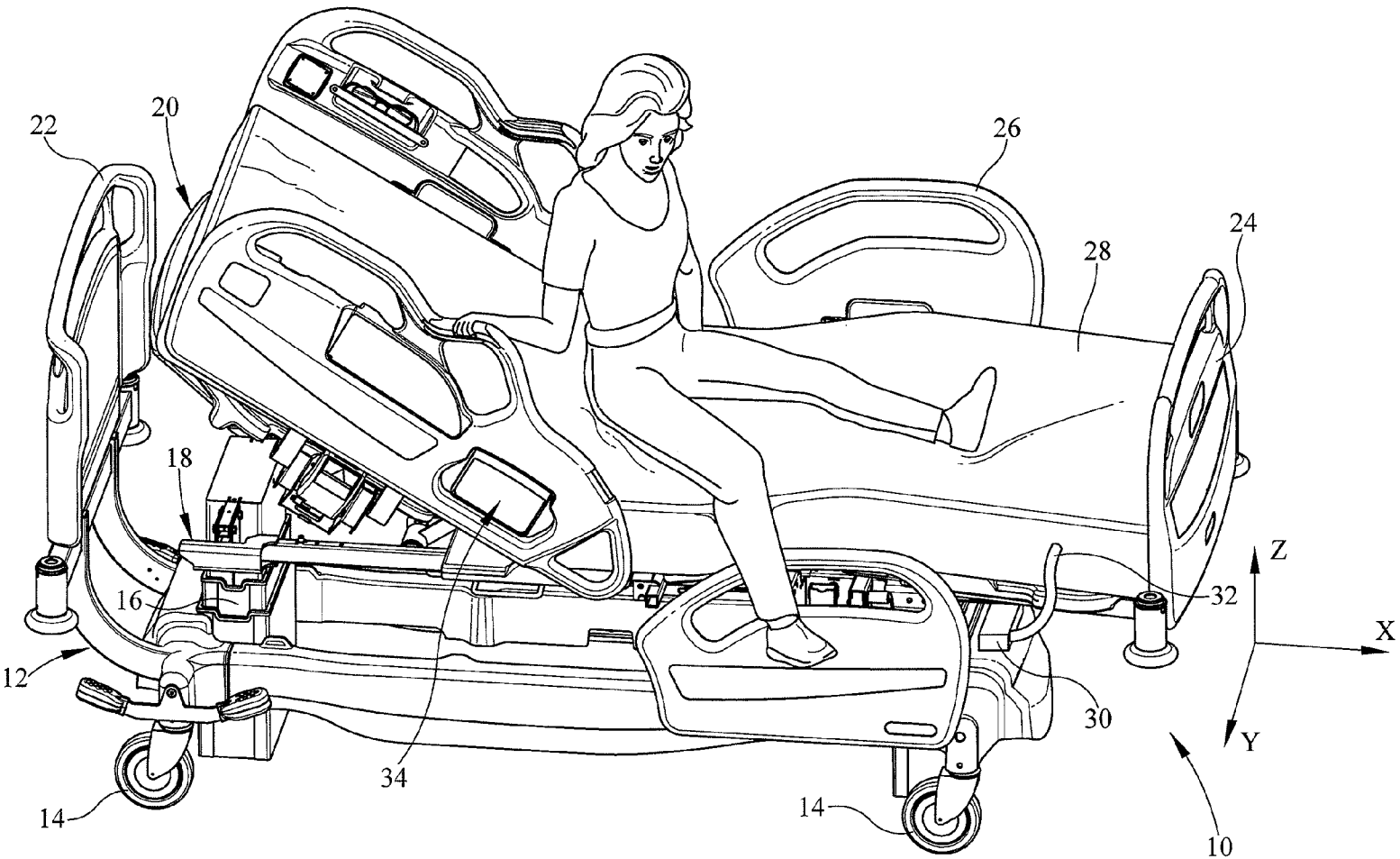
FIG. 1 is a perspective view of a person support apparatus, constructed according to one or more of the principles disclosed herein.

The embodiments of the claimed subject matter and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be briefly mentioned or omitted so as to not unnecessarily obscure the embodiments of the claimed subject matter described. The examples used herein are intended merely to facilitate an understanding of ways in which the claimed subject matter may be practiced and to further enable those of skill in the art to practice the embodiments of the claimed subject matter described herein. Accordingly, the examples and embodiments herein are merely illustrative and should not be construed as limiting the scope of the claimed subject matter, which is defined solely by the appended claims and applicable law. Moreover, it is noted that like reference numerals represent similar parts throughout the several views of the drawings.

It is understood that the subject matter claimed is not limited to the particular methodology, protocols, devices, apparatus, materials, applications, etc., described herein, as these may vary. It is also to be understood that the terminology used herein is used for the purpose of describing particular embodiments only, and is not intended to limit the scope of the claimed subject matter.

Unless defined otherwise, all technical and scientific terms used herein have the same meanings as commonly understood by one of ordinary skill in the art.

The subject matter herein is directed to a person support apparatus comprising systems and methods for providing spring assistance system for articulation of a head support section of the person support apparatus over a portion of the range of motion of the head support section.

As shown in FIG. 1 a person support apparatus 10 comprises a lower frame 12 supported on wheels 14. In this embodiment person support apparatus 10 is a bed, while in other embodiments the person support apparatus 10 may be a stretcher or any other furniture. An intermediate frame 18 is supported by and configured to variably elevate with respect to lower frame 12 by supports 16 as shown in FIG. 1. In this embodiment the intermediate frame 18 supports a weigh frame 36 (shown in FIGS. 2, 4-8). At least one deck section 20 is supported on the weigh frame 36. In this embodiment the deck section 20 comprises at least one head support deck section 38 (shown in FIGS. 2, 4-8) configured to support the upper body of a person, a seat support deck section configured to support the seat section of a person and a foot support deck section 40 (shown in FIGS. 2, 4-8) configured to support the feet of a person. In another embodiment the deck section 20 may comprise any number of sections. In yet another embodiment the intermediate frame 18 may serve the function of the deck section 20 and be comprised of multiple sections.

The person support apparatus 10 also comprises a head board 22 defining the head end, a foot board 24 defining the foot end and side rails 26 defining the lateral extremities of the person support apparatus 10. A mattress 28 is configured to rest upon the deck section 20 of the person support apparatus 10 in this embodiment. In another embodiment, the mattress 28 may be configured to rest upon the intermediate frame 18. A fluid supply 30 is configured to supply fluid into the mattress 28 through an inlet 32. In this embodiment the fluid supply 30 is a compressor while in other embodiments the fluid supply 30 may be a blower or a pump. In the embodiment shown in FIG. 1 the fluid supply is mounted on the lower frame 12, while in another embodiment the fluid supply 30 is mounted on the foot board 24. In other embodiments, the fluid supply 30 may be mounted on any other portion of the person support apparatus 10 such as the side rails 26 or the deck section 20. In yet another embodiment the fluid supply 30 may be configured to rest on the floor. In this embodiment the fluid supply 30 is dedicated to the system for supplying dedicated fluid flow in a mattress, while in another embodiment the fluid supply 30 is configured to supply fluid for other uses.

A user interface 34 is mounted on the side rail 26 as shown in FIG. 1 in this embodiment while in another embodiment the user interface 34 is configured to be a hand held pendant. In yet another embodiment the user interface 34 may be at a remote location and configured to communicate with the bed controller wirelessly. The user interface 34 displays system messages and/or allows a caregiver to input control parameters. A co-ordinate system is disclosed in FIG. 1 to assist in description of relative positions and motions. As shown, X axis is configured to pass through the middle of the width of the person support apparatus. Axis Y is orthogonal to the X axis such that the X-Y plane is substantially parallel to the weigh frame. Axis Z is orthogonal to the X-Y plane.

Embodiments of person support systems are found in patents U.S. Pat. No. 7,296,312, U.S. Pat. No. 6,047,424 and patent application publication US2007/0266499, all of which are incorporated by reference herein.

Figure 2:
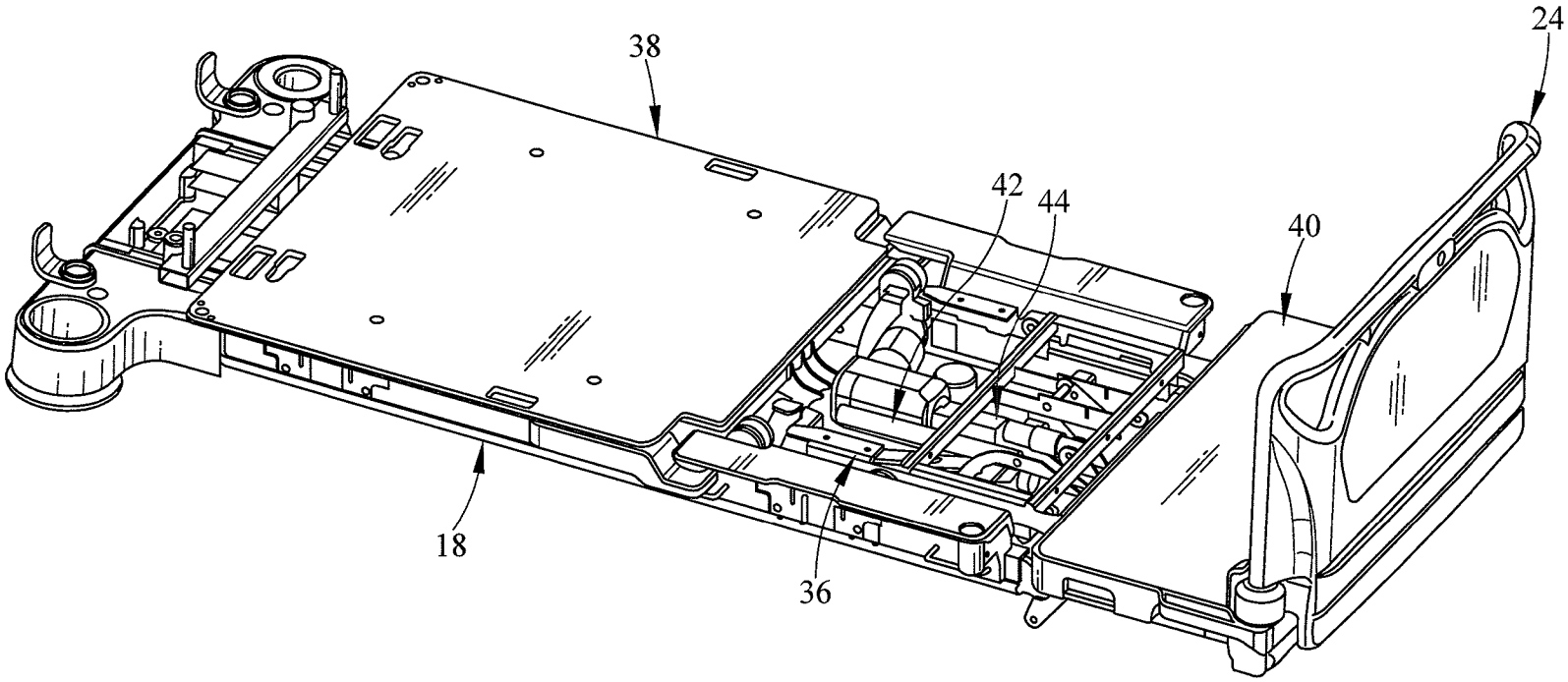
FIG. 2 is a perspective view of a portion of a person support apparatus showing a spring assembly to aid in articulation, the head support deck section is in the flat position, constructed according to one or more of the principles disclosed herein.

FIG. 2 shows a portion of the person support apparatus 10 showing the intermediate frame 18 supporting a weigh frame 36. The weigh frame 36 supports deck section 20. In FIG. 2, a seat support deck section has been hidden to show the spring assembly 42. Actuator 44 is configured to change the inclination of the head support deck section 38 with respect to the weigh frame 36. The angle of inclination of the head support deck section 38 with respect to the weigh frame 36, and thereby with respect to the X-Y plane, is also known as the head of bed (HOB) angle. As the inclination of the head support deck section 38 with respect to the weigh frame 36 is increased, at a particular HOB angle further increase in the HOB angle causes the spring assembly 42 to compress a spring 58 (shown in FIG. 3). The actuator 42 acts against the spring 58 for further increase in HOB angle. In this embodiment the particular HOB angle after which further increase in HOB angle causes the spring assembly 42 to compress a spring 58 (shown in FIG. 3) is 45 degrees. In another embodiment the particular HOB angle after which further increase in HOB angle causes the spring assembly 42 to compress a spring 58 is selected from a range of greater than 0 degrees and less than 50 degrees. This can be accomplished by designing and/or mounting the spring assembly to determine this angle, in one embodiment the HOB angle is determined by choosing the free length of spring 58 versus the length of the tube 48 and/or length of the rod 52 (shown in FIG. 3) of the spring assembly 42.

Figure 3:
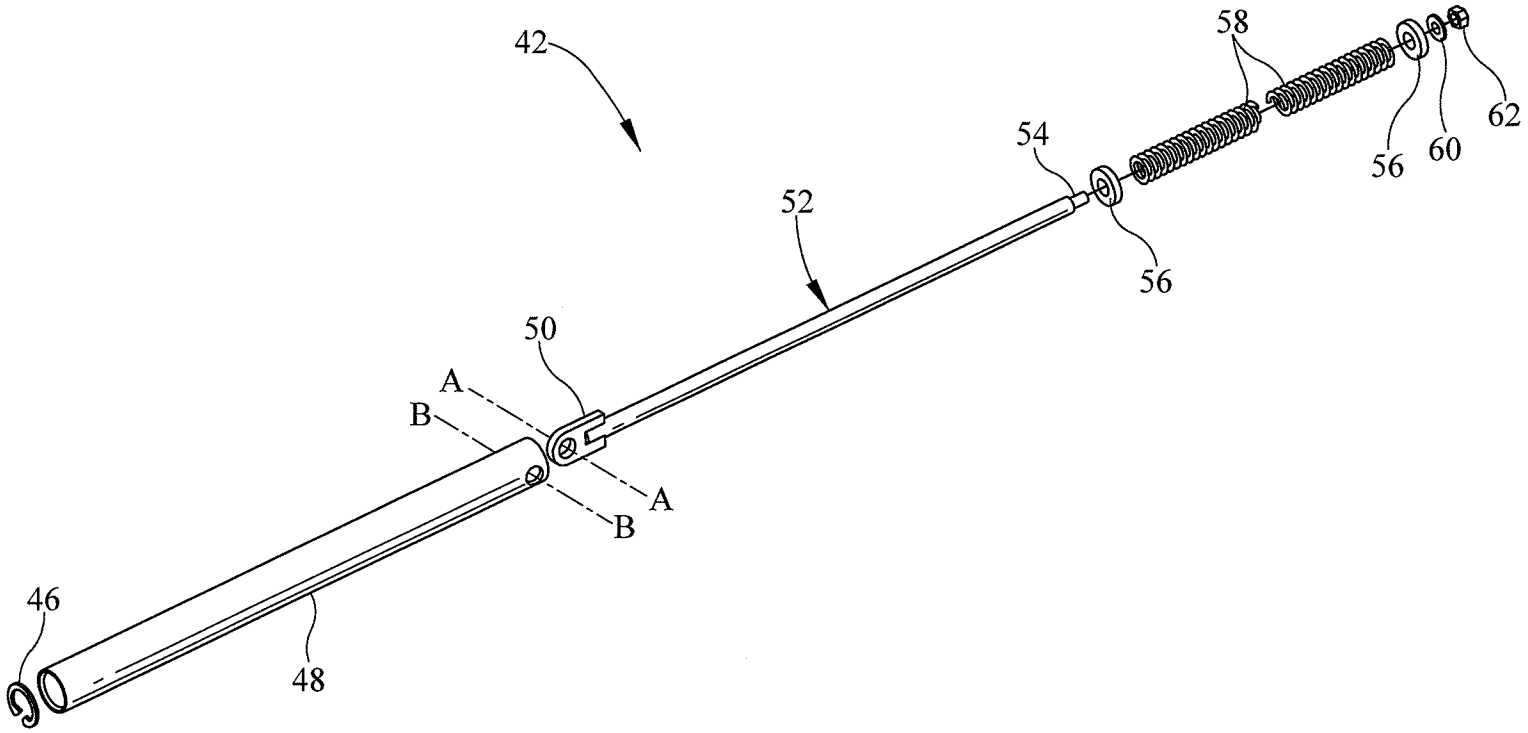
FIG. 3 is an exploded perspective view of the spring assembly for use with a person support apparatus, constructed according to one or more of the principles disclosed herein.

FIG. 3 is an exploded view showing one embodiment of a spring assembly 42. Rod 52 is configured to coaxially translate within the tube 48. The rod 52 comprises a rod pivot end 50 and a rod fastener end 54. In this embodiment, rod 52 is mechanically connected to the head deck support section 38 by a pin joint defined by rod pivot axis A-A. A spring guide 56 is configured to slide over rod 52 and spring 58 is positioned after the spring guide 56. Another spring guide 56 is configured to slide onto the rod after the spring 58 has been installed. In this embodiment the spring 58 comprises two physically separate sections placed in series. In another embodiment, the spring 58 comprises one section while in another embodiment the spring 58 comprises any number of sections in series and/or parallel. A washer 60 is configured to mount on the rod fastener end 54. In this embodiment the rod fastener end 54 is threaded and a nut 62 is configured to capture the spring 58 and spring guides 56 on to the rod 52 between the rod pivot end 50 and the rod fastener end 54. In other embodiments, any other type of fasteners may be used instead of nut 62 including but not limited to a spring loaded clamp, retaining ring and a cotter pin. The tube 48 is pivotally connected to the weigh frame 36 about the tube pivot axis B-B. In this embodiment, one end of the spring assembly 42 is connected to the head support deck section 38 at axis A-A while the other end of the spring assembly 42 is connected to the weigh frame 36 at axis B-B. In this embodiment the free length of spring 58 is less than the distance between tube pivot axis B-B and the retaining ring 46. In this embodiment the retaining ring 46 is mounted internally in the tube 48 to limit axial motion of the spring guide 56 and spring 58 within the tube 48.

Figure 4:
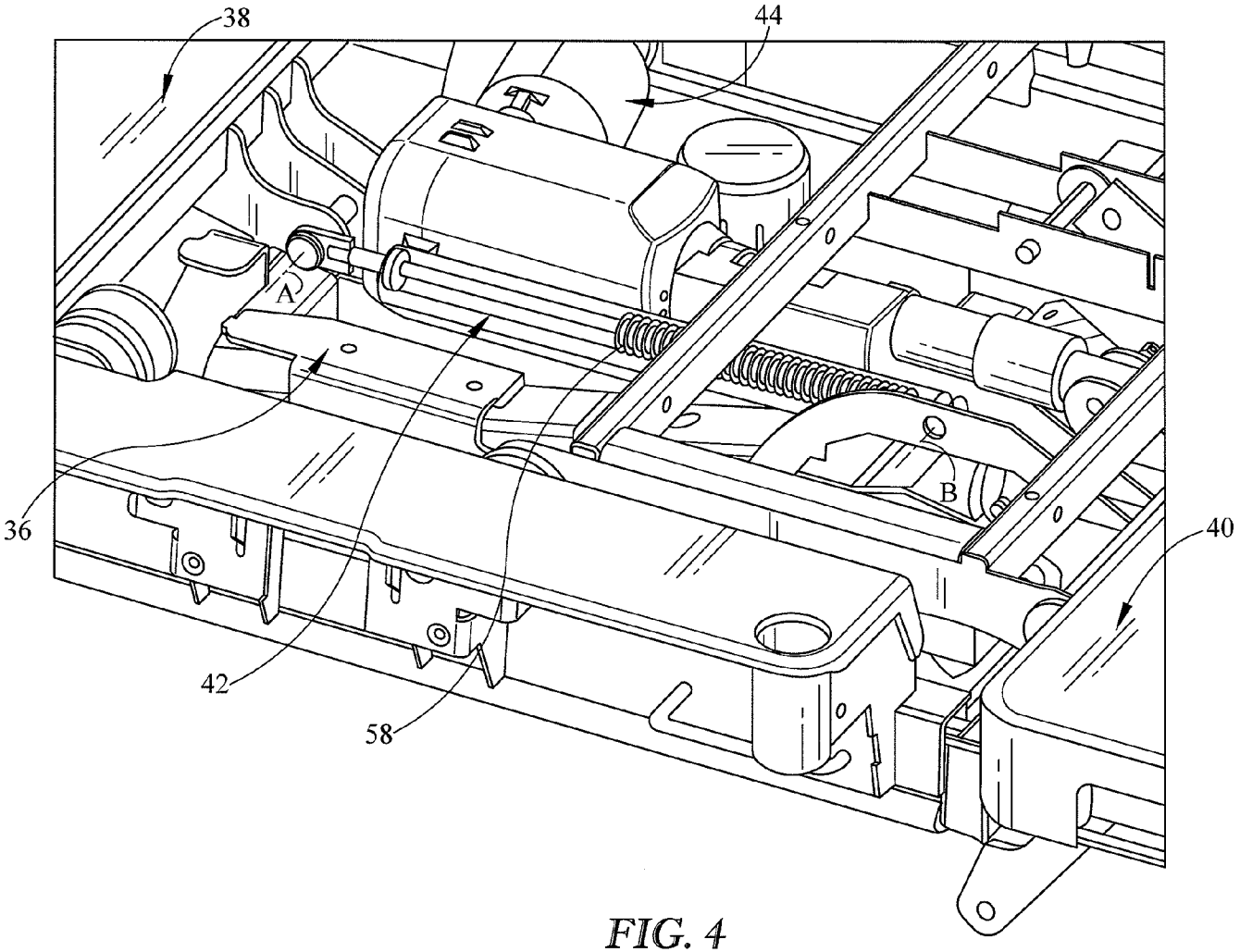
FIG. 4 is a close-up perspective view of a portion of a person support apparatus showing a spring assembly to aid in articulation, the head support deck section is in the flat position, constructed according to one or more of the principles disclosed herein.

FIG. 4 shows the spring assembly 42 connected to the head support deck section 38 at the rod pivot end 50 about the rod pivot axis A-A and to the weigh frame 36 about the tube pivot axis B-B. As shown in FIG. 4, when the head support deck section 38 is substantially parallel to the X-Y plane, the spring 58 is in an uncompressed state.

Figure 5:
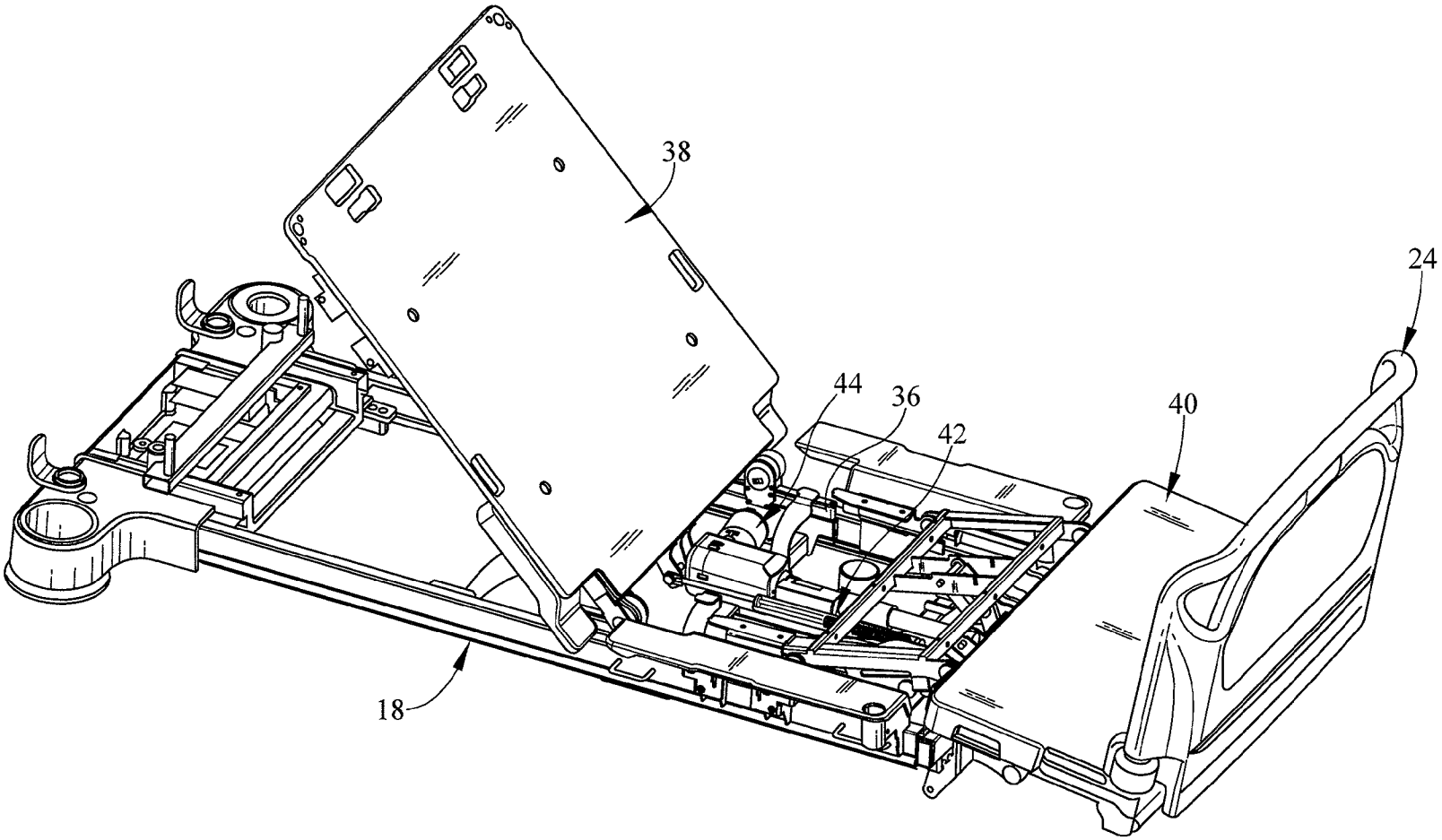
FIG. 5 is a perspective view of a portion of a person support apparatus showing a spring assembly to aid in articulation, the head support deck section is at an inclination of 45 degrees with respect to the horizontal, constructed according to one or more of the principles disclosed herein.
Figure 6:
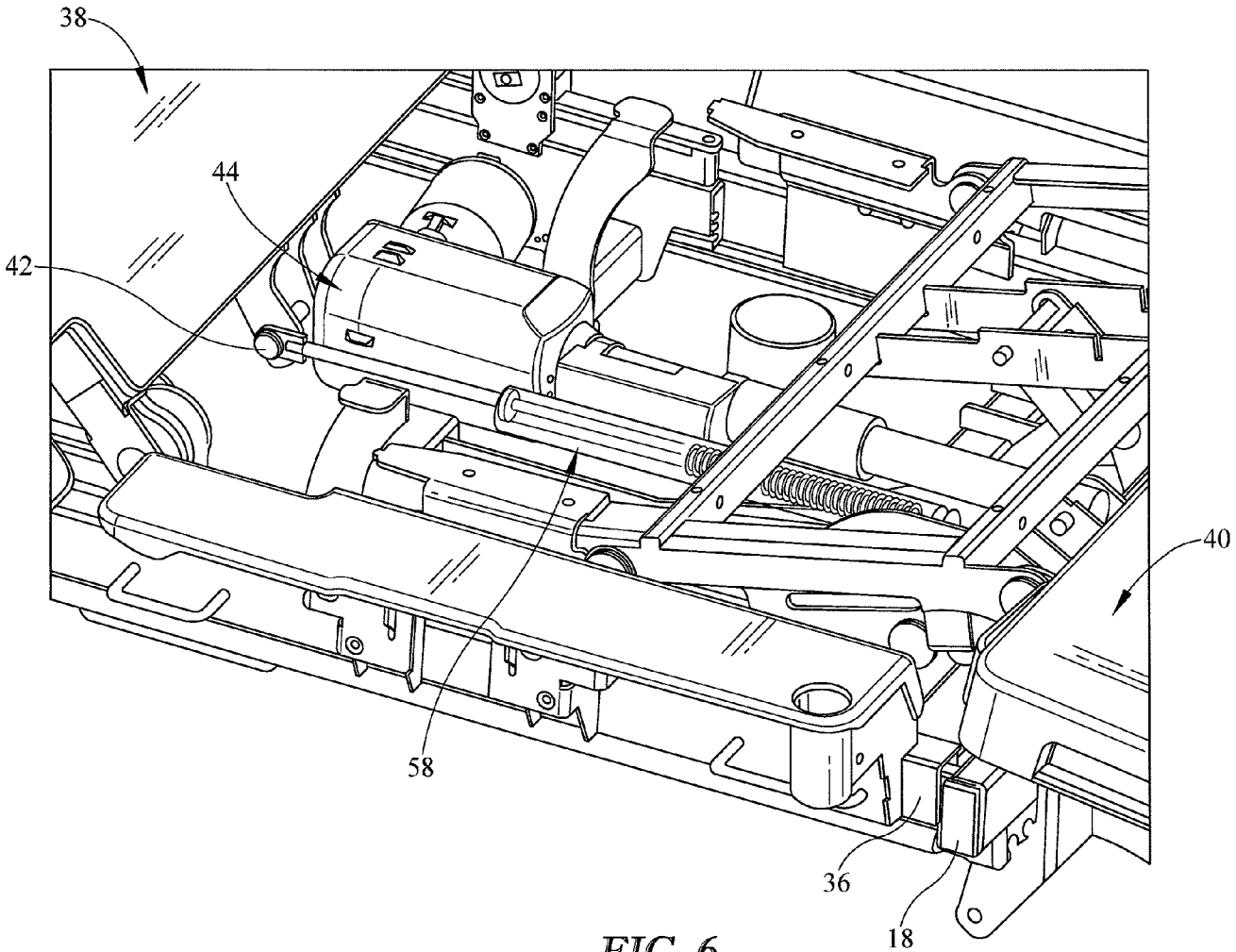
FIG. 6 is a close-up perspective view of a portion of a person support apparatus showing a spring assembly to aid in articulation, the head support deck section is at an inclination of 45 degrees with respect to the horizontal, constructed according to one or more of the principles disclosed herein.

FIG. 5 shows the head support deck section 38 inclined at 45 degrees with respect to the X-Y plane. In this embodiment, any further increase in inclination of the head support deck section 38 results in compression of spring 58. Therefore, any further increase in inclination of the head support deck section 38 entails overcoming the spring force required to compress spring 58 as shown in FIG. 6.

Figure 7:
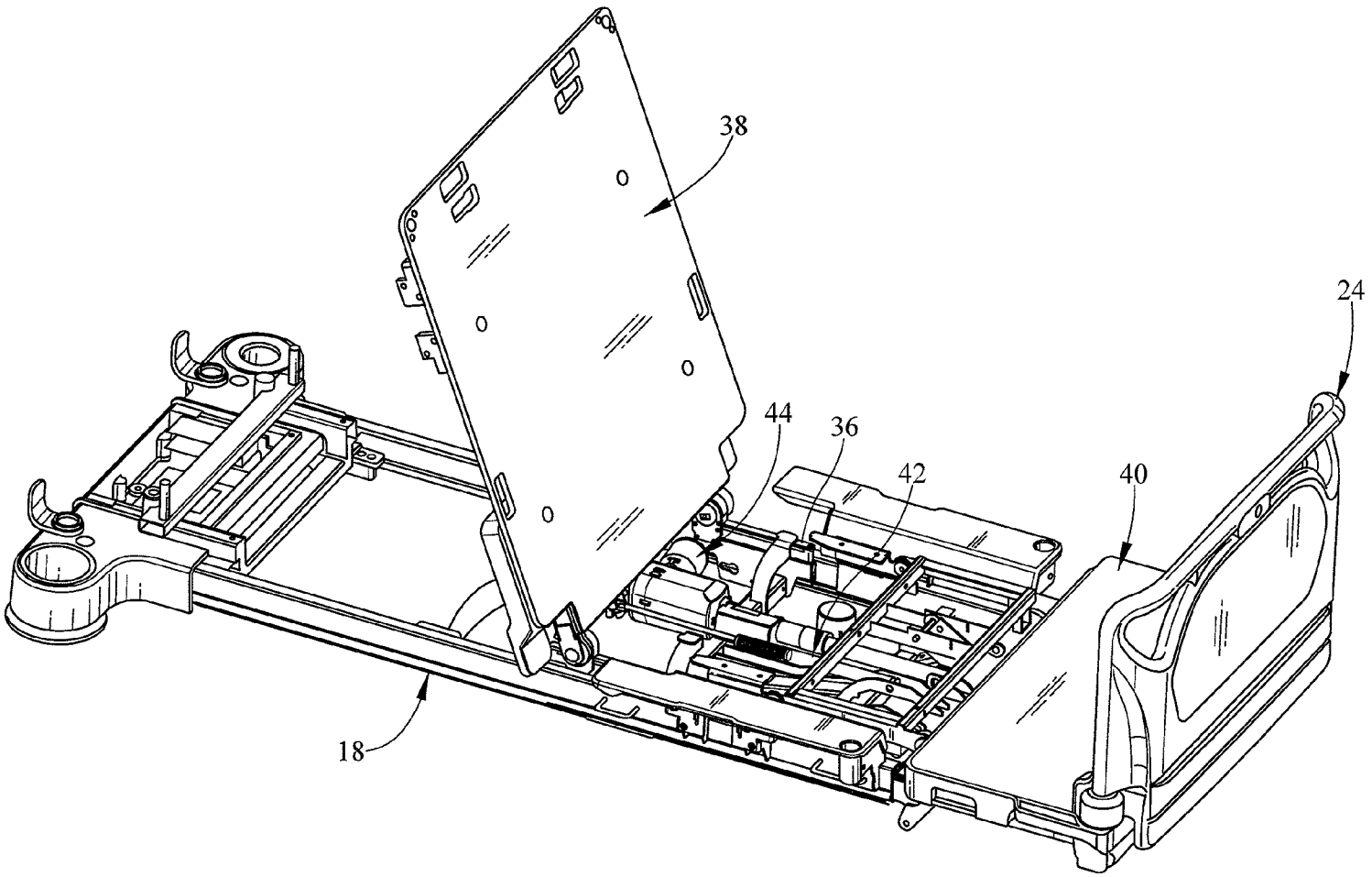
FIG. 7 is a perspective view of a portion of a person support apparatus showing a spring assembly to aid in articulation, the head support deck section is at full angular inclination with respect to the horizontal, constructed according to one or more of the principles disclosed herein.
Figure 8:
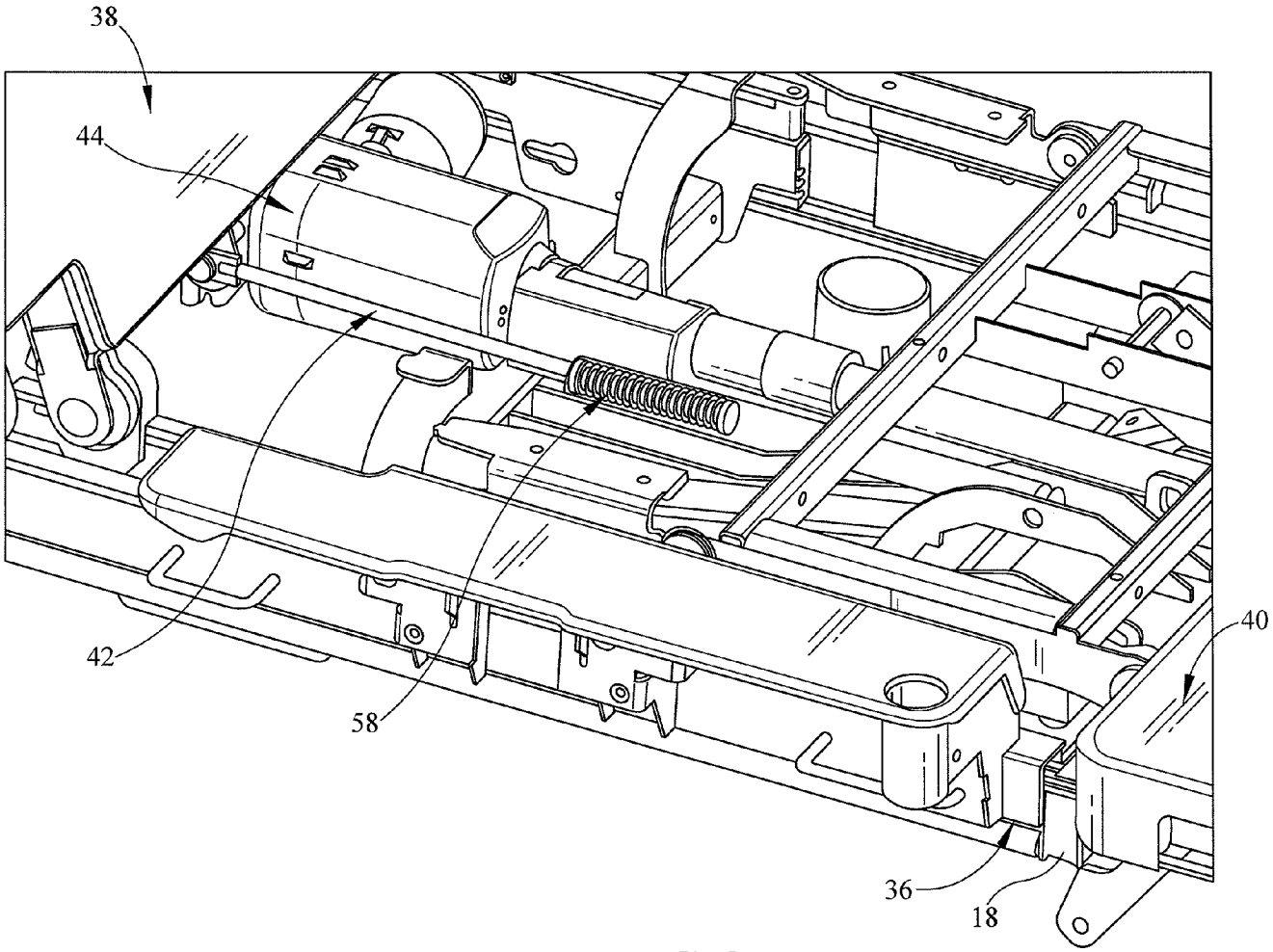
FIG. 8 is a close-up perspective view of a portion of a person support apparatus showing a spring assembly to aid in articulation, the head support deck section is at full angular inclination with respect to the horizontal, constructed according to one or more of the principles disclosed herein.

FIGS. 7 and 8 show the head support deck section 38 at its maximum inclination with respect to the X-Y plane. In this embodiment the head support deck section 38 is configured to be at an angular inclination of substantially 65 degrees with respect to the X-Y plane, while in another embodiment the maximum inclination of the head support deck section 38 may be selected as any value less than 100 degrees. As shown in FIGS. 7 and 8 the spring 58 is compressed to a state of maximum compression when the head support deck section 38 is at maximum inclination. In this embodiment, the free uncompressed length of the spring is 6 inches while the maximum compressed length is 3 inches therefore the total compression of the spring is 3 inches. In this embodiment the spring constant (K) is selected as 30 pound force per inch (lbf/in). Using equation 1 below the magnitude of the spring force vector acting from axis A-A to axis B-B (pulling the head support deck section to a lower inclination) can be calculated. When the spring 58 is in a state of maximum compression a force of 90 lbf acts in the direction aiding the reduction of inclination of the head support deck section 38.

$$\text{Spring Force } (F) = \text{Spring Constant } (K) \times \text{Spring Compression } (X) \qquad \text{Eq. 1}$$

In other embodiments, any value of spring compression (compressed and/or uncompressed lengths of spring) and spring constant may be selected. The spring assembly 42 described above is configured to apply a spring force acting from axis A-A to axis B-B (pulling the head support deck section to a lower inclination) from a particular HOB angle from which further increase in the HOB angle causes the spring assembly 42 to compress a spring 58 to the maximum inclination of the head support deck section 38.

The spring assembly described herein serves to aid in lowering the head support deck section 38 from any angle of inclination greater than a particular HOB angle from which further increase in the HOB angle causes the spring assembly 42 to compress a spring 58. This may be helpful in situations wherein power failure and/or failure of the electronics on the person support apparatus 10 and/or failure of the actuator 44 coincide with the need to reduce angle of inclination of the head support deck section 38 from any angle of inclination greater than a particular HOB angle from which further increase in the HOB angle causes the spring assembly 42 to compress a spring 58. In one embodiment, administration of CPR to a person supported by the person support apparatus 10 may require reducing the angle of inclination of the head support deck section 38 and the spring assembly 42 described herein provides an assistive spring force assisting a caregiver to lower the angle of inclination of the head support deck section 38. In this embodiment, the spring force acts exclusively from any angle of inclination greater than a particular HOB angle from which further increase in the HOB angle causes the spring assembly 42 to compress a spring 58. In one embodiment the normal range of inclination for the head support deck section 38 for daily activities of the person supported by the person support apparatus is between 0 and 45 degrees and the spring assembly 42 is not compressed for most of the duration of use of the person support apparatus 10. Therefore for most of the duration of use of the person support apparatus 10, additional spring force does not need to be overcome by the actuator 44. Since in this embodiment the spring assembly 42 is not mounted along the longitudinal centerline of the person support apparatus 10, compression of the spring 58 may result in side loading on the head support deck section 38. However since for most of the duration of use of the person support apparatus 10, additional spring force does not need to be overcome by the actuator 44, side loading on the head support deck section 38 is avoided. In another embodiment the spring assembly 42 is configured to mount along the longitudinal centerline of the person support apparatus 10 and compression of the spring 58 is configured to not result in side loading on the head support deck section 38.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

The disclosures of any references and publications cited above are expressly incorporated by reference in their entireties to the same extent as if each were incorporated by reference individually.

The invention claimed is:

1. A spring assist system for use with a person support apparatus comprising a head support deck section supported by a supporting frame, said head support deck section configured to be variably inclined with respect to said supporting frame through an overall range of motion between a raised position and a lowered position, the spring assist system comprising:

a spring assembly comprising a spring configured to apply spring force assisting downward motion to lower said head support deck section through only a portion of the overall range of motion of the head support deck section that is less than the overall range of motion, the portion of the overall range being defined from a first position to a second position, wherein said head support deck section in said first position is at greater angle of inclination with respect to said supporting frame than in said second position and angular inclination of said head support deck section in said second position is greater than 0 degrees and less than 50 degrees with respect to said supporting frame such that no spring force is provided by the spring to the head support deck section at an end portion of the downward range of movement of said head support deck section toward and into the lowered position, said spring assembly configured to apply spring force exclusively between said first position and said second position, wherein the spring assembly further includes a tube and a rod that extends and retracts relative to the tube, wherein the spring is situated inside of the tube and is secured to the rod, the spring traveling with the rod relative to the tube while the spring remains in an uncompressed state as the head support deck section is raised from the lowered position toward the raised position until the rod reaches a position relative to the tube corresponding to the second position of the head support deck section at which point the spring begins to compress within the tube during further movement of the deck section toward the first position and toward the raised position.

2. The spring assist system of claim 1, wherein said head support deck section is at 45 degree angle of inclination with respect to said supporting frame in said second position.

3. The spring assist system of claim 1, wherein said head support deck section is at 65 degree angle of inclination with respect to said supporting frame in said first position.

4. The spring assist system of claim 1, wherein said supporting frame is a weigh frame.

5. The spring assist system of claim 1, wherein said spring is a linear spring.

6. The spring assist system of claim 5, wherein said spring has a spring constant of 30 pound force per inch.

7. A person support apparatus comprising:

a lower frame;

an intermediate frame;

at least one support configured to variably elevate said intermediate frame over said lower frame;

a weigh frame supported by said intermediate frame;

a deck section supported by said weigh frame, said deck section configured to support a portion of a person's upper body thereon, said deck section configured to be inclined with respect to said weigh frame through an overall range of motion between a raised position and a lowered position; and a spring assembly comprising a spring configured to apply spring force assisting downward motion to lower said deck section through only a portion of the overall range of motion of the deck section that is less than the overall range of motion, the portion of the overall range being defined from a first position to a second position, wherein said deck section in said first position is at greater angle of inclination with respect to said weigh frame than in said second position and angular inclination of said deck section in said second position is greater than 0 degrees and less than 50 degrees with respect to said weigh frame such that no spring force is provided to the deck section by the spring at an end portion of the downward range of movement of said deck section toward and into the lowered position, said spring assembly configured to apply spring force exclusively between said first position and said second position, wherein the spring assembly further includes a tube and a rod that extends and retracts relative to the tube, wherein the spring is situated inside of the tube and is secured to the rod, the spring traveling with the rod relative to the tube while the spring remains in an uncompressed state as the deck section is raised from the lowered position toward the raised position until the rod reaches a position relative to the tube corresponding to the second position of the deck section at which point the spring begins to compress within the tube during further movement of the deck section toward the first position and toward the raised position.

8. The person support apparatus of claim 7, wherein said deck section is at 45 degree angle of inclination with respect to said weigh frame in said second position.

9. The person support apparatus of claim 7, wherein said deck section is at 65 degree angle of inclination with respect to said weigh frame in said first position.

10. The person support apparatus of claim 7 wherein said spring is a linear spring.

11. The person support apparatus of claim 10, wherein said spring has a spring constant of 30 pound force per inch.

12. The spring assist system of claim 1, wherein the spring comprises at least one coil spring that coils around the rod inside the tube.

13. The spring assist system of claim 12, wherein the at least one coil spring comprises two separate coil spring sections placed in series on the rod.

14. The person support apparatus of claim 7, wherein the spring comprises at least one coil spring that coils around the rod inside the tube.

15. The person support apparatus of claim 14, wherein the at least one coil spring comprises two separate coil spring sections placed in series on the rod.

16. The spring assist system of claim 1, wherein the first position is the raised position.

17. The person support apparatus of claim 7, wherein the first position is the raised position.

* * * * *